US009167915B1

(12) United States Patent
Lau

(10) Patent No.: US 9,167,915 B1
(45) Date of Patent: Oct. 27, 2015

(54) COMMODITY SHELVING SYSTEM

(71) Applicant: Chun Piu Lau, Kwai Chung N.T. (KR)

(72) Inventor: Chun Piu Lau, Kwai Chung N.T. (KR)

( * ) Notice: Subject to any disclaimer, the term of this patent is extended or adjusted under 35 U.S.C. 154(b) by 0 days.

(21) Appl. No.: 14/475,586

(22) Filed: Sep. 3, 2014

Related U.S. Application Data

(60) Provisional application No. 61/901,000, filed on Nov. 7, 2013.

(51) Int. Cl.
*A47B 57/26* (2006.01)
*A47F 5/01* (2006.01)

(52) U.S. Cl.
CPC ..... *A47F 5/01* (2013.01)

(58) Field of Classification Search
CPC .... A47B 57/26; A47B 57/265; A47B 96/024; A47B 96/06; A47F 5/01
USPC ..... 211/182, 187
See application file for complete search history.

(56) References Cited

U.S. PATENT DOCUMENTS 4,318,352 A * 3/1982 Friedman et al. ..... 108/107
4,656,952 A * 4/1987 Schweizer ..... 108/11
4,750,626 A * 6/1988 Nicely ..... 211/187
5,127,342 A * 7/1992 Taylor ..... 108/147.13
5,487,227 A * 1/1996 Marmonier ..... 36/117.1
5,884,567 A * 3/1999 Bartz, Jr. ..... 108/106
6,044,988 A * 4/2000 Yang ..... 211/187
6,068,143 A * 5/2000 Wang ..... 211/187
6,253,933 B1 * 7/2001 Yang ..... 211/187
7,478,971 B2 * 1/2009 Li ..... 403/398
8,678,207 B2 * 3/2014 Shimazaki et al. ..... 211/187
2010/0108631 A1 * 5/2010 McAllister et al. ..... 211/187

* cited by examiner

*Primary Examiner* — Joshua Rodden
(74) *Attorney, Agent, or Firm* — George G. Wang; Bei & Ocean

(57) ABSTRACT

A commodity shelving system includes pillars, shelves and a fixing mechanism for fixing the shelves to the pillars, wherein the fixing mechanism has a plurality of pillar clamps and locking pieces having an amount corresponding to that of the pillar clamps; and the locking pieces are arranged at corners of the shelves. Each of the pillar clamps includes a left fastener and a right fastener mutually coupleable by a snap fit structure and respectively provided with a semicircular groove matched with the pillar and a protruded portion arranged at an outside of an end edge of the semicircular groove; and each of the locking pieces is provided with a clamping portion for coupling with the protruded portion of the pillar clamp.

10 Claims, 8 Drawing Sheets

COMMODITY SHELVING SYSTEM

TECHNICAL FIELD

The present invention relates to a shelving system for commodities.

BACKGROUND ART

The existing widely used shelving system needs to be assembled sequentially from the bottommost layer to the topmost layer and an additional layer cannot be added thereinto after the system is assembled. If the user wants to increase or decrease the number of the layers, or change the level of a certain layer, the whole system needs to be disassembled reassembled again. However, the existing shelving system is relatively difficult to assemble and disassemble.

SUMMARY OF THE INVENTION

One object of the present invention is to provide a shelving system for commodities.

To this end, the present invention provides a commodity shelving system comprising pillars, shelves and a fixing mechanism for fixing the shelves on the pillars, wherein the fixing mechanism comprises a plurality of pillar clamps and locking pieces having an amount corresponding to that of the pillar clamps; the locking pieces are arranged at corners of the shelves; wherein each of the pillar clamps comprises a left fastener and a right fastener mutually coupleable by a snap fit structure and respectively provided with a semicircular groove matched with the pillar and a protruded portion arranged at an outside of an end edge of the semicircular groove; and each of the locking pieces is provided with a clamping portion for coupling with the protruded portion of the pillar clamp.

As a preferred embodiment, the snap fit structure comprises a receiving trough arranged at the left fastener and a plug arranged at the right fastener for matching with the receiving trough of the left fastener.

As a preferred embodiment, the receiving trough has a cross section of a T shape, and the plug has also a cross section of a T shape corresponding thereto.

As a preferred embodiment, a circumference formed by jointing together the semicircular grooves of the left fastener and the right fastener is slightly smaller than a circumference of the pillar.

As a preferred embodiment, a difference between the circumferences ranges from 0.8 mm to 1.2 mm, and more preferably, the difference is 1 mm.

As a preferred embodiment, the protruded portion of the left fastener and the protruded portion of the right fastener respectively comprise a tongue-shaped piece having its bottom part fixedly connected with a main body of respective fasteners and its upper part separated from the main body of respective fasteners by a predefined distance.

As a preferred embodiment, the clamping portion of the locking piece comprises an arc-shaped wall; and an inner surface of the arc-shaped wall is matched with outer surfaces of the semicircular grooves of the left fastener and the right fastener; and a thickness of the arc-shaped wall is slightly smaller than the predefined distance between the upper part of the tongue-shaped piece and the main body of respective fasteners; a notch with its opening faced downwardly is arranged in a middle part of the arc-shaped wall, so as to enable the arc-shaped wall to be inserted into and engaged between the left and right fasteners and respective tongue-shaped pieces via the notch. Preferably, the respective outer surfaces of the semicircular grooves of the left fastener and the right fastener are respectively provided with a boss; when the pillar clamp is engaged with the locking piece, both ends of the arc-shaped wall of the locking piece lean against the boss respectively.

As a further preferred embodiment, the clamping portion of the locking piece comprises a slot for matching with the tongue-shaped piece; wherein an outer side wall of the slot faced toward the pillar clamp is an arc-shaped side wall; and an inner surface of the arc-shaped side wall is matched with outer surfaces of the semicircular grooves of the left fastener and the right fastener; and a thickness of the arc-shaped side wall is slightly smaller than the predefined distance between the upper part of the tongue-shaped piece and the main body of respective fasteners; a notch with its opening faced downwardly is arranged in a middle part of the arc-shaped side wall, so as to enable the arc-shaped side wall to be inserted into and engaged between the left and right fasteners and respective tongue-shaped pieces via the notch; and also enable the tongue-shaped pieces of the left fastener and the right fastener to be received and enclosed by the slot.

As a preferred embodiment, both side ends of the arc-shaped side wall of the slot respectively extend outward to form an arc-shaped groove matched with respective outer surfaces of the semicircular grooves of the left fastener and the right fastener.

As a preferred embodiment, the respective outer surfaces of the semicircular grooves of the left fastener and the right fastener are respectively provided with a boss; when the pillar clamp is engaged with the locking piece, both ends of the arc-shaped groove formed from the arc-shaped side wall of the slot pillar lean against the boss respectively.

Preferably, the fixing mechanism is made of at least one of following materials: plastic, metal, alloy, and other adaptive materials.

DETAILED DESCRIPTION OF PREFERRED EMBODIMENTS

Figure 1:
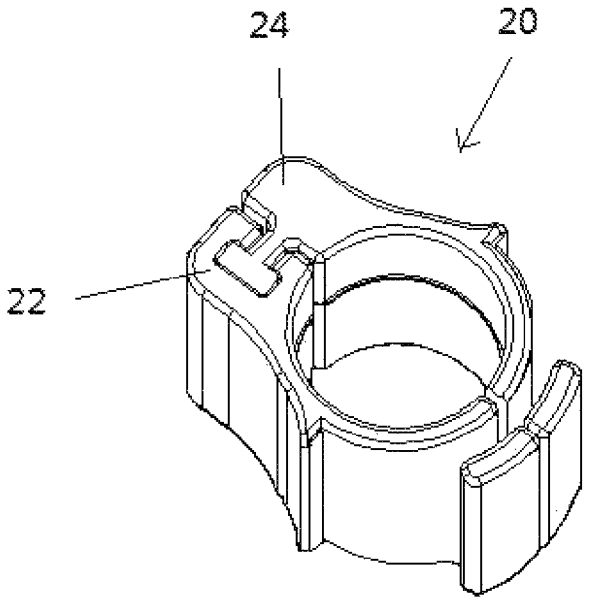
FIG. 1 is a schematic view of an embodiment of pillar clamps of the fixing mechanism of a commodity shelving system according to the present invention.
Figure 2:
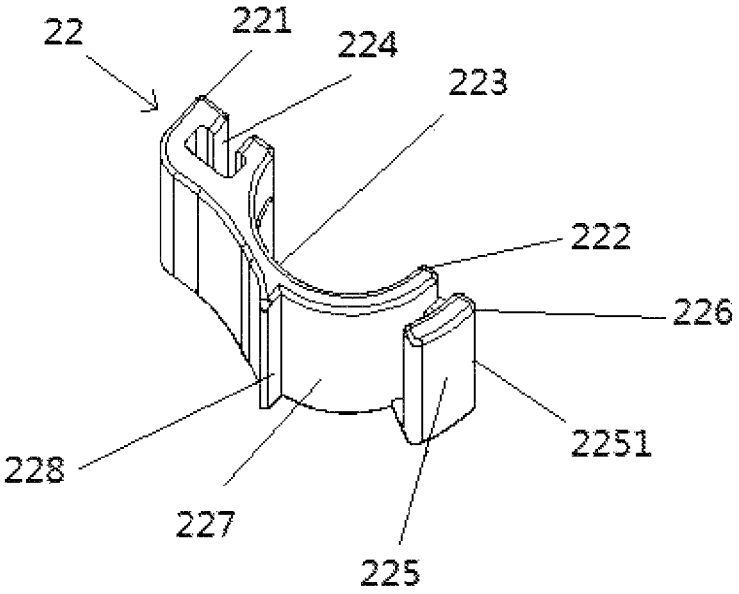
FIG. 2 is a schematic view of a left fastener of the pillar clamp as shown in FIG. 1.
Figure 3:
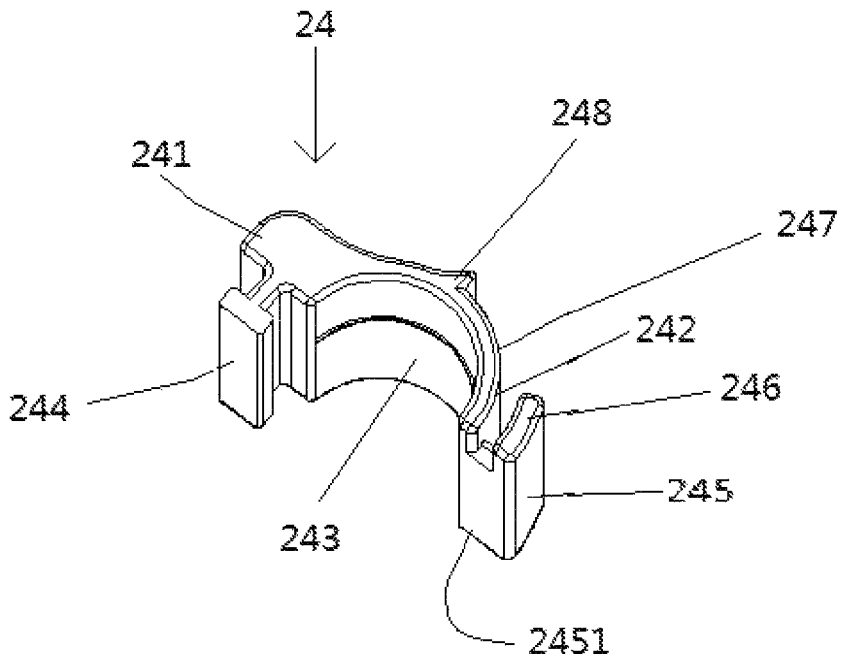
FIG. 3 is a schematic view of a right fastener of the pillar clamp as shown in FIG. 1.

The preferred embodiments of the commodity shelving system of the present invention will be described below in details with reference to the accompanied drawings, though it will be apparent to those skilled in the art that some features that are not particularly important to the understanding of the commodity shelving system may not be shown in the accompanied drawings for the sake of clarity.

In addition, it should also be understood that the commodity shelving system described in the present application is not limited to the specific embodiments described below and that various alterations and modifications may be made thereto by those skilled in the art without departing from the spirit or scope of the present application. For example, elements and/or features of various illustrative embodiments may be combined with each other and/or substituted for each other within the scope of the present application.

The present invention provides a commodity shelving system comprising pillars, shelves and a fixing mechanism for fixing the shelves to the pillars. The system of the present invention is easy in assembling and disassembling, and capable of altering the quantity and level of the shelves without disassembling the whole system.

Referring to FIG. 1 to FIG. 10, which illustrate an embodiment of the fixing mechanism of the commodity shelving system provided by the present invention, wherein the fixing mechanism comprises four pillar clamps 20 and four locking pieces 40 with slots. The locking pieces are used for replacing collars used at the corners of the existing shelving systems.

The pillar clamp 20 comprises a left fastener 22 and a right fastener 24. The left fastener and the right fastener can be easily combined together and fixedly clamped at a proper position of the pillar 30 through structures as described below.

The left fastener 22 of the pillar clamp 20 comprises a first portion 221 and a second portion 222, wherein the first portion 221 is provided with a receiving trough 224 opening toward the right fastener 24. In this embodiment, the cross section of the receiving trough 224 is in a "T" shape; the second portion 222 is provided with a semicircular groove 223 extending longitudinally and opening toward the right fastener 24; a protruded portion 225 is arranged outside the end edge of the second portion 222; the bottom of the protruded portion 225 is fixedly connected with the second portion, while the portion above the bottom is separated from the second portion by a specific distance, so that the protruded portion 225 forms a tongue-shaped piece 226; the protruded portion 225 is provided with a side wall 2251 facing toward the right fastener 24. The outer side wall of the second portion 222 is arc-shaped, and the side wall 227 of the arc-shaped portion extends from the end edge and terminates at a boss 228.

The right fastener 24 of the pillar clamp 20 comprises a first portion 241 and a second portion 242, wherein the first portion 241 is provided with a plug 244 projecting toward the left fastener 22. In this embodiment, the cross section of the plug 244 is in a "T" shape; the T-shaped plug 244 is mutually matched with the T-shaped receiving trough 224 of the first portion of the left fastener 22 of the pillar clamp 20; the second portion 242 is provided with a semicircular groove 243 extending longitudinally and opening toward the left fastener 22; the semicircular groove 243 corresponds with the semicircular groove 223 of the second portion of the left fastener 22; a protruded portion 245 is arranged outside the end edge of the second portion 242; the bottom of the protruded portion 245 is fixedly connected with the second portion, while the portion above the bottom is separated from the second portion by a preset distance, so that the protruded portion 245 forms a tongue-shaped piece 246; the height and the shape of the tongue-shaped piece 246 are the same as those of the tongue-shaped piece 226 of the second portion of the left fastener; the protruded portion 245 is provided with a side wall 2451 facing toward the left fastener 22. The outer side wall of the second portion 242 is arc-shaped, and the side wall 247 of the arc-shaped portion extends from the end edge and terminates at a boss 248.

When mounting on the pillar 30, the T-shaped receiving trough 224 of the left fastener 22 of the pillar clamp 20 is engaged with the T-shaped plug 244 of the right fastener 24, while the semicircular groove of the left fastener 22 of the pillar clamp 20 is leaned against with the semicircular groove of the right fastener 24, and their inner surfaces are closely in contact with the surface of the pillar 30, at the moment, the protruded portion (i.e., tongue-shaped piece) of the second portion of the left fastener and the project portion of the second portion of the right fastener are arranged side by side, and the corresponding opposite side walls of them are positioned adjacent to each other.

Alternatively, the receiving trough 224 of the left fastener 22 and the plug 244 of the right fastener 24 may be designed to adopt any other adaptive shapes, including but not limited to: Ω shape, inverted triangle, and on the like, for example. It is obvious that the receiving trough of the left fastener and the plug of the right fastener can be transposed, that is to say, the plug might be selectively arranged at the left fastener and the receiving trough might be accordingly arranged at the right fastener.

In order to fasten the pillar clamp 20 on the pillar, the circumference formed by joining the semicircular groove of the left fastener and the semicircular groove of the right fastener is slightly less than the circumference of the pillar; the difference ranges from about 0.8 mm to 1.2 mm, and preferably the difference is 1 mm.

Figure 4:
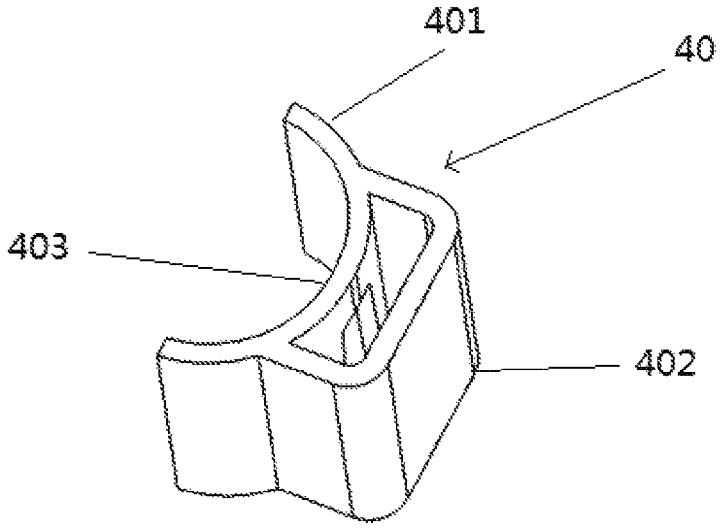
FIG. 4 is a schematic view of an embodiment of a locking piece of the commodity shelving system of the present invention.
Figure 5:
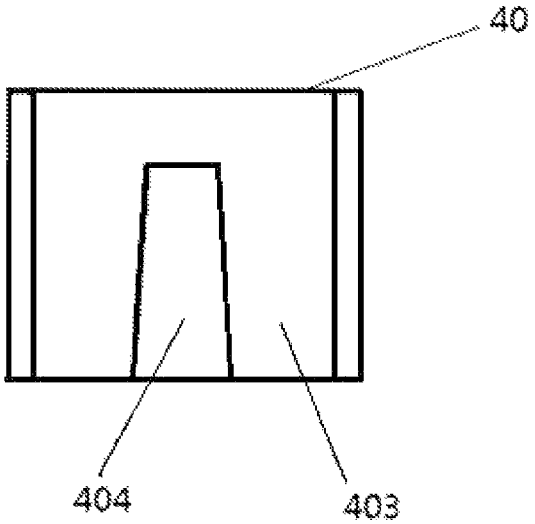
FIG. 5 is a side view of the locking piece as shown in FIGS. 4 and 4A for showing the inner surface of the arc-shaped groove or arc-shaped wall of the locking piece.
Figure 6:
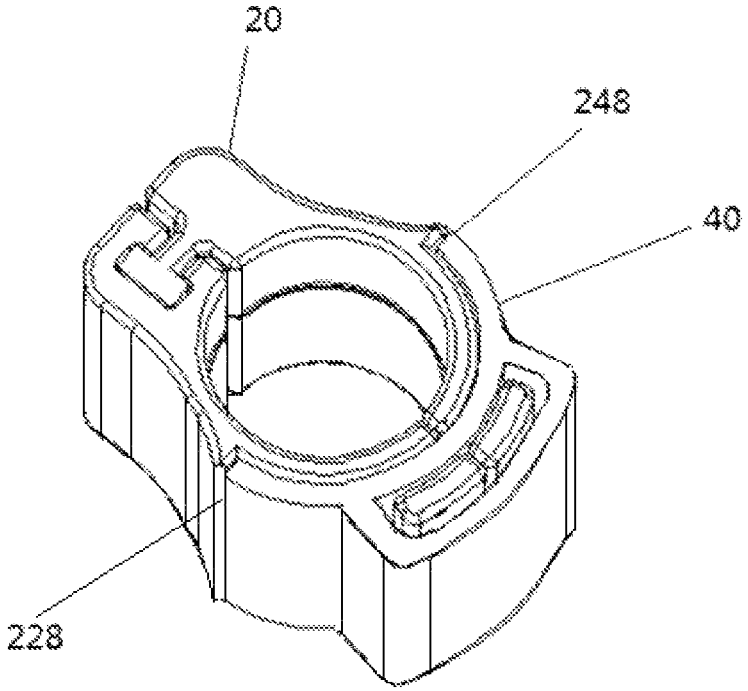
FIG. 6 is a schematic view of the assembled fixing mechanism of the commodity shelving system of the present invention.
Figure 7:
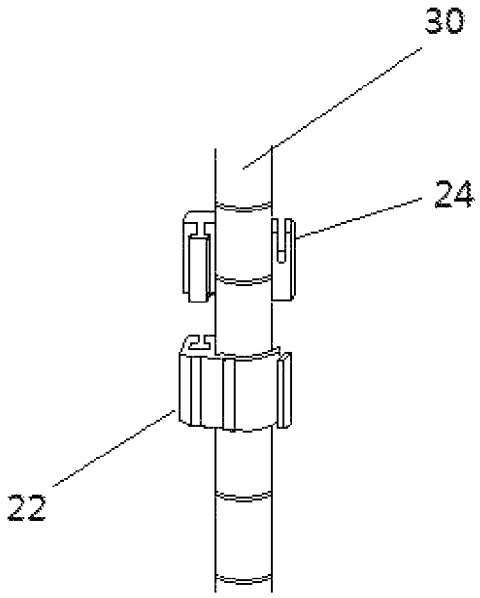
FIG. 7 is a schematic view showing that the right fastener is in alignment with the left fastener of the pillar clamp and prepared for insertion as shown in FIG. 1.
Figure 8:
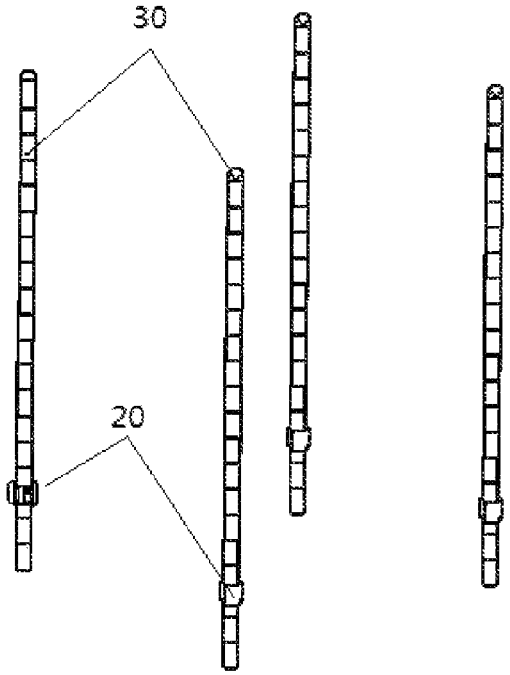
FIG. 8 is a schematic view of four pillar clamps arranged on the respective pillars and adjusted to the positions for assembly of the commodity shelving system.
Figure 9:
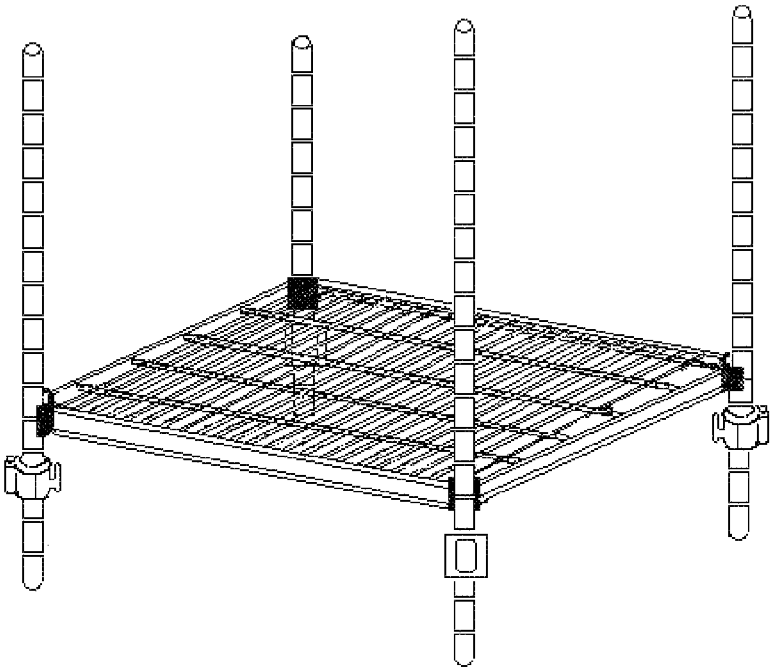
FIG. 9 is a schematic view of shelves located in the center of the commodity shelving system.
Figure 10:
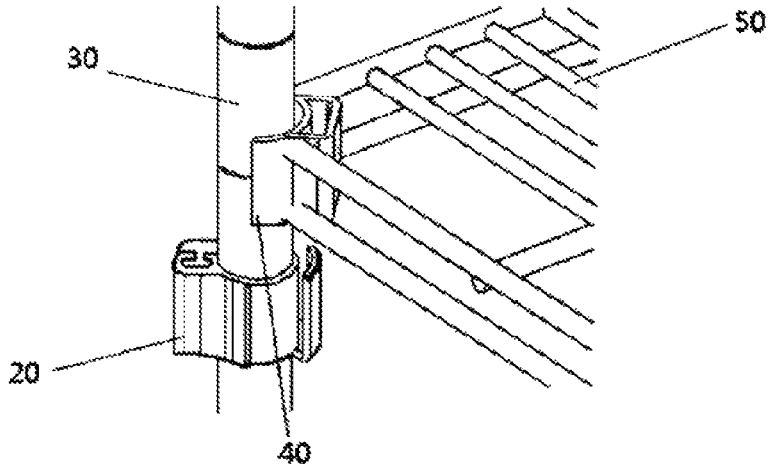
FIG. 10 shows the position of the locking piece for aligning with the pillar clamp.
Figure 11:
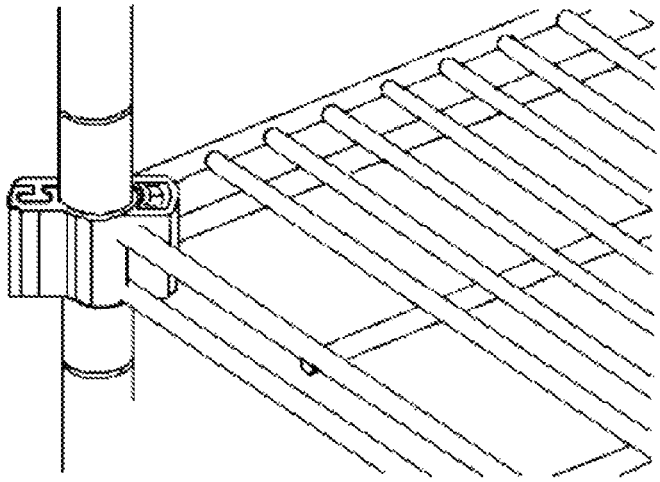
FIG. 11 shows the locking pieces inserted into the pillar clamps.
Figure 12:
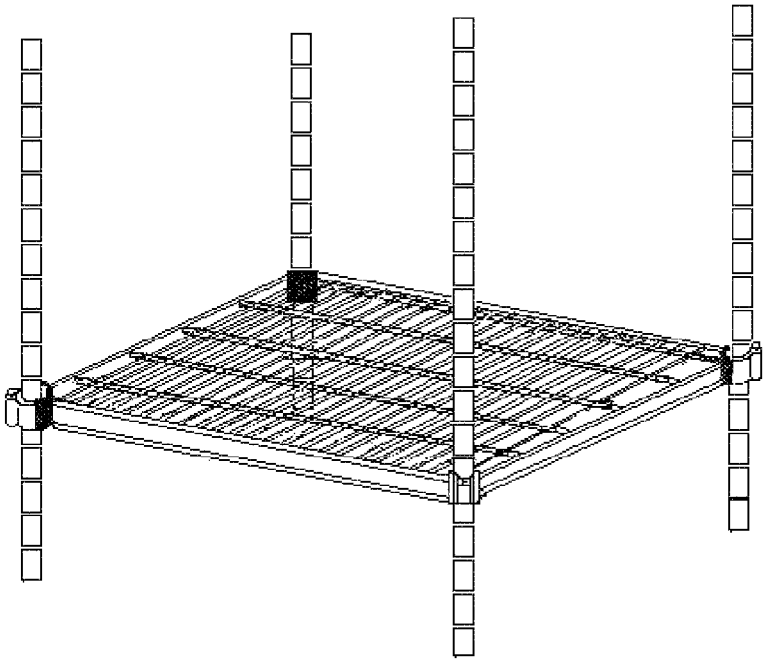
FIG. 12 is a schematic view showing that the locking pieces arranged at four corners of the shelves had been mounted and inserted into the pillar clamps.
Figure 13:
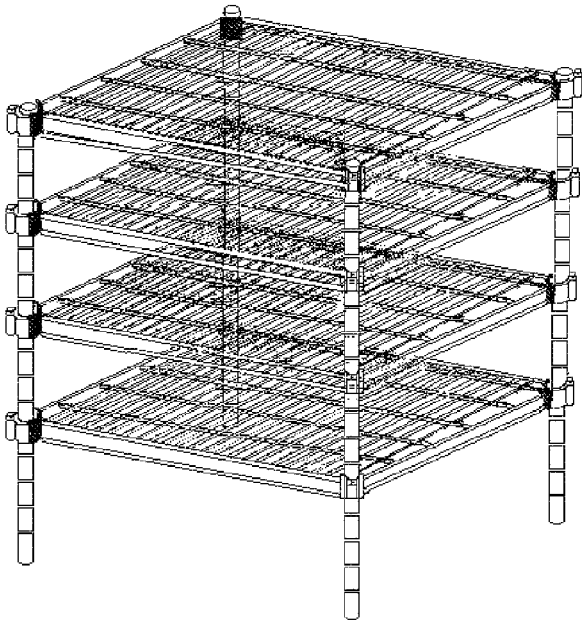
FIG. 13 is a schematic view of the assembled commodity shelving system.

As shown in FIGS. 4 and 5, the locking piece 40 of the present embodiment comprises a clamping portion for engaging with the protruded portion (i.e., tongue-shaped piece) of the pillar clamp 20, and the clamping portion comprises an arc-shaped groove 401 and a slot 402 arranged at the outer wall of the arc-shaped groove 401. One portion of the arc-shaped groove 401 forms a side wall 403 of the slot 402, a notch 404 with its opening faced downwardly is arranged in the middle of the side wall 403, and the thickness of the side wall 403 is slightly smaller than the distance between the tongue-shaped piece and the second portion of the left fastener and the right fastener of the pillar clamp 20, so as to enable the arc-shaped side wall to be inserted into and engaged firmly between the second portion of the left and right fasteners and respective tongue-shaped pieces via the notch 404; and also enable the tongue-shaped pieces 226, 246 of the left fastener and the right fastener to be received and enclosed duly by the slot 402 The inner surface of the arc-shaped groove 401 is matched with the arc-shaped side wall of the left fastener and the arc-shaped side wall of the right fastener of the pillar clamp 20, so that the pillar clamp 20 may be clamped on the pillar firmly after completing the installation thereof. The arc-shaped groove 401 of the clamping portion is formed by respectively extending outwardly the both side ends of the side wall 403 forming the slot 402.

As the circumference formed by the semicircular grooves of the left fastener and the right fastener are slightly less than the circumference of the pillar, the respective end edges of the semicircular groove of the second portion of the left fastener and the semicircular groove of the second portion of the right fastener cannot be closely joined and a clearance is formed when the left fastener and the right fastener are joined together around the pillar. When the locking piece 40 is mounted on the pillar clamp 20, the arc-shaped groove 401 of the locking piece 40 clamps the arc-shaped side wall of the left fastener and the arc-shaped side wall of the right fastener, and both end sides of the arc-shaped groove 401 of the locking piece 40 pillar will duly lean against the respective bosses 228, 248 of the second portions of the left fastener and the right fastener.

The locking pieces 40 are arranged at each corner of the shelf 50 and integrally formed with the shelf 50. The shelf 50 may be either a triangular shelf with three corners (not shown) or a polygonal shelf with a plurality of corners, including but not limited to the quadrilateral shelves in the above embodiment, for example.

The size of the pillar clamps and the locking pieces are matched with the size of the pillar, and these parts are preferably made in a complementary manner.

The pillar clamps and the locking pieces may be made of a plastic material, a metallic material, an alloy material, or a combination thereof, for example, the inner wall of the semicircular groove of the pillar clamp might be made of a plastic material while the rest portions might be made of a metallic material. The materials shall be selected based on the predetermined supporting capacity of the commodity shelving system.

Figure 4A:
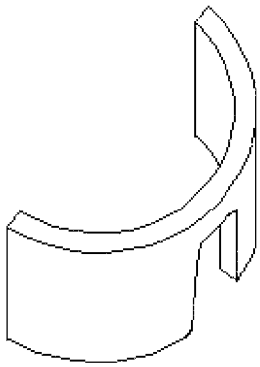
FIG. 4A is a schematic view of another embodiment of a locking piece of the commodity shelving system of the present invention.

In another embodiment as shown in FIGS. 4A and 5, the locking piece of the embodiment is structurally equivalent to the same of the previous embodiment except that it does not comprise the slot, and it could be employed when the pillar clamp and the locking piece are made of a metallic material or an alloy material. Specifically, the clamping portion of the locking piece comprises an arc-shaped wall; and an inner surface of the arc-shaped wall is matched with outer surfaces of the semicircular grooves of the left fastener and the right fastener; and a thickness of the arc-shaped wall is slightly smaller than the distance between the tongue-shaped piece and the second portion of the respective fasteners of the pillar clamp 20. A notch with its opening faced downwardly is arranged in a middle part of the arc-shaped wall, so as to enable the arc-shaped wall to be inserted into and engaged between the left and right fasteners and respective tongue-shaped pieces via the notch. When the pillar clamp is engaged with the locking piece, both ends of the arc-shaped wall of the locking piece will lean against the bosses 228 and 248 of the second portions of the left and right fasteners, respectively.

Referring to FIG. 7 to FIG. 13, the method for assembling the commodity shelving system comprises the following steps:

Step 1: assembling the base of the commodity shelving system:

selecting an appropriate position of the lower portion of the circular pillar at which the left fastener of the pillar clamp is positioned, then pressing the left fastener on the curved surface of the pillar, and positioning the right fastener of the pillar clamp above the left fastener at the opposite side of the curved surface of the pillar, and aligning the plug of the right fastener with the receiving trough of the left fastener, and then sliding down the right fastener until the plug is completely inserted into the receiving trough of the left fastener.

Step 2: repeating step 1 until the four pillar clamps have all been mounted at the corresponding position of each pillar.

Step 3: putting a meshed shelf on the floor, and then positioning the four pillars at the four corners of the meshed shelf, rotating each of the pillars until the protruded portion of each pillar clamp is faced toward the locking piece at the corner of the meshed shelf.

Step 4: putting the locking piece at the corner of the meshed shelf right above the protruded portion of the pillar clamp, and then inserting the locking piece between the main body and the protruded portion of the pillar clamp and enclosing the tongue-shaped piece of the pillar clamp.

Step 5: repeating step 4 until the other three pillars have all been mounted properly.

Step 6: completing the mounting of the bottommost shelf of the commodity shelving system.

Step 7: mounting the other shelves of the commodity shelving system:

selecting an appropriate position at which the left fastener of the pillar clamp is positioned, then pressing the left fastener on the curved surface of the pillar, and positioning the right fastener of the pillar clamp above the left fastener at the opposite side of the curved surface of the pillar, and aligning the plug of the right fastener with the receiving trough of the left fastener, and then sliding down the right fastener until the plug of the right fastener is completely inserted into the receiving trough of the left fastener.

Step 8: repeating step 7 until the four pillar clamps have all been mounted at the corresponding position of each pillar.

Step 9: rotating each pillar clamp until the protruded portion is faced toward the corresponding position as the lower one.

Step 10: putting another meshed shelf in the commodity shelving system, then positioning the four locking pieces of the meshed shelf just above the protruded portions of the four pillar clamps, putting down the meshed shelf and inserting the locking pieces at the four corners of the meshed shelf between the main bodies and the protruded portions of the four pillar clamps and enclosing the tongue-shaped pieces of the pillar clamps, and gently beating the corners of the meshed shelf with a hammer to fasten the meshed shelf on the pillar clamps.

Step 11: repeating step 7 to step 10 until all shelves have been mounted thereto.

Figure 14:
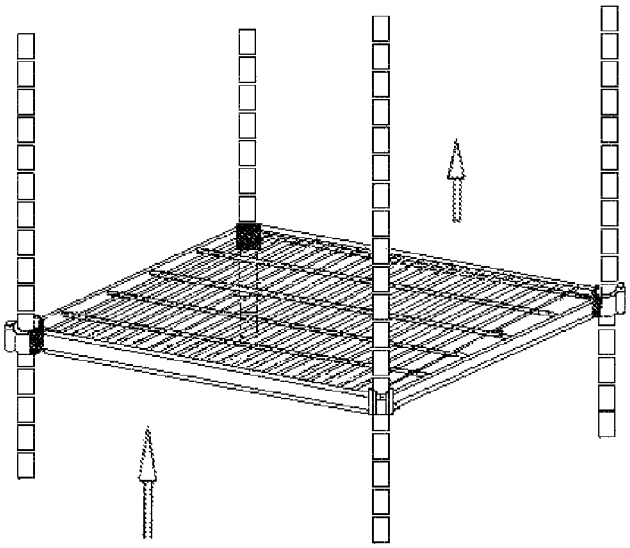
FIG. 14 is a schematic view of the shelves to be disassembled and elevated.
Figure 15:
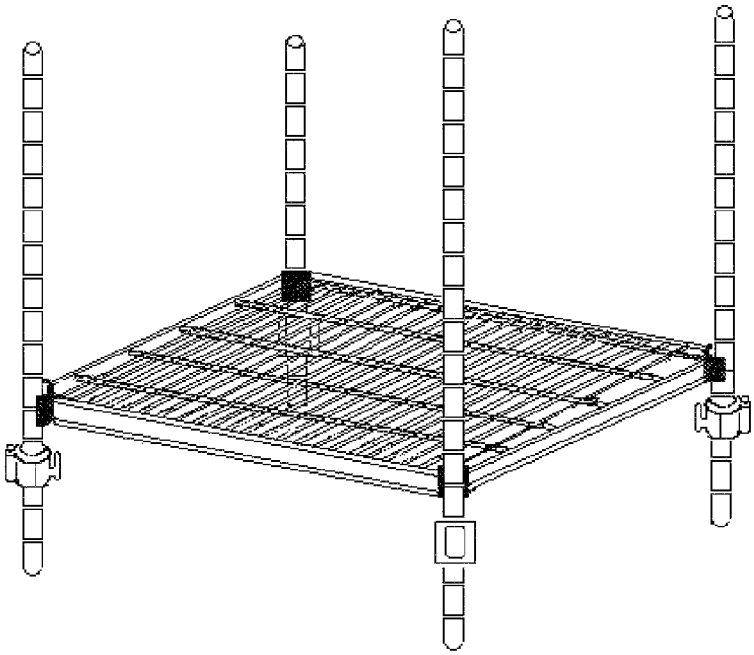
FIG. 15 is a schematic view showing the disassembled and elevated shelves.

Referring to FIG. 14 to FIG. 15, the method for disassembling the commodity shelving system comprises the steps as follows:

Step 1: hitting slightly four corners of the mesh shelf to be removed with a hammer, for example:

holding the mesh shelf by one hand while hitting four corners of the mesh shelf with the hammer by the other hand until each of locking pieces loosen out from respective slots of pillar clamps; when four corners of the mesh shelf loosen from the pillar clamps, remove the mesh shelf from the system.

Step 2: removing the pillar clamps from the pillars:

holding merely the left fastener of the pillar clamp and pressing the bottom of the right fastener until the right fastener disengages with the left fastener of the pillar clamp.

The pillar clamp includes the following advantages:

1. it can clip easily on the pillar at any position thereof;

2. it can hold firmly the mesh shelf in position; and 3. it can be removed easily without interfering the other shelves of the shelving system.

The locking piece includes the following advantages:

1. it can hold firmly the mesh shelf in position;

2. it can be removed easily without interfering the other shelves of the shelving system; and 3. it enables a relatively easy assembly of the mesh shelf.

Various alterations and modifications may be also made by those skilled in the art without departing from the concept of the present invention, and all of them shall be considered within the scope of the present invention. In this way, the scope of the present invention shall be limited by the claims appended hereto.

What is claimed is:

1. A commodity shelving system comprising pillars, shelves and a fixing mechanism for fixing the shelves to the pillars, wherein the fixing mechanism comprises a plurality of pillar clamps and locking pieces, the locking pieces having an amount corresponding to that of the pillar clamps;

and the locking pieces are arranged at corners of the shelves; wherein each of the pillar clamps comprises a left fastener and a right fastener mutually coupleable by a snap fit structure and respectively provided with a semicircular groove matched with the pillar and a protruded portion arranged at an outside of an end edge of the semicircular groove; and each of the locking pieces is provided with a clamping portion for coupling with the protruded portions of the pillar clamp;

wherein the protruded portion of the left fastener and the protruded portion of the right fastener respectively comprise a tongue-shaped piece having its bottom part fixedly connected with a main body of the respective one of the left and right fasteners and its upper part separated from the main body of the respective one of the left and right fasteners by a predefined distance;

wherein the clamping portion of the locking piece comprises a slot for matching with each of the tongue-shaped pieces; wherein an outer side wall of the slot faced toward the pillar clamp is an arc-shaped side wall; and an inner surface of the arc-shaped side wall is matched with outer surfaces of the semicircular grooves of the left fastener and the right fastener; and a thickness of the arc-shaped side wall is slightly smaller than the predefined distance between the upper part of the tongue-shaped piece and the main body of the respective one of the left and right fasteners; a notch with its opening faced downwardly is arranged in a middle part of the arc-shaped side wall, so as to enable the arc-shaped side wall to be inserted into and engaged between the left and right fasteners and respective tongue-shaped pieces via the notch; and also enable the tongue-shaped pieces of the left fastener and the right fastener to be received and enclosed by the slot.

2. The commodity shelving system according to claim 1, wherein the snap fit structure comprises a receiving trough arranged at the left fastener and a plug arranged at the right fastener for matching with the receiving trough of the left fastener.

3. The commodity shelving system according to claim 2, wherein the receiving trough has a cross section of a T shape, and the plug has a cross section of a T shape corresponding thereto.

4. The commodity shelving system according to claim 1, wherein a circumference formed by jointing together the semicircular grooves of the left fastener and the right fastener is slightly smaller than a circumference of the pillar.

5. The commodity shelving system according to claim 4, wherein a difference between the circumferences ranges from 0.8 mm to 1.2 mm.

6. The commodity shelving system according to claim 4, wherein a difference between the circumferences is 1 mm.

7. The commodity shelving system according to claim 1, wherein the respective outer surfaces of the semicircular grooves of the left fastener and the right fastener are respectively provided with a boss; when the pillar clamp is engaged with the locking piece, both ends of the arc-shaped wall of the locking piece lean against one of the bosses respectively.

8. The commodity shelving system according to claim 1, wherein both side ends of the arc-shaped side wall of the slot the respectively extend outward to form an arc-shaped groove matched with respective outer surfaces of the semicircular grooves of the left fastener and the right fastener.

9. The commodity shelving system according to claim 8, wherein the respective outer surfaces of the semicircular grooves of the left fastener and the right fastener are respectively provided with a boss; when the pillar clamp is engaged with the locking piece, both ends of the arc-shaped groove of the locking piece lean against one of the boss respectively.

10. The commodity shelving system according to claim 1, wherein the fixing mechanism is made of at least one of following materials: plastic, metal, alloy, and other adaptive materials.

* * * * *